US009398375B2

(12) United States Patent
Akino

(10) Patent No.: US 9,398,375 B2
(45) Date of Patent: Jul. 19, 2016

(54) ELECTRODYNAMIC ELECTROACOUSTIC TRANSDUCER, DIAPHRAGM THEREOF, AND METHOD OF MANUFACTURING THE SAME

(71) Applicant: KABUSHIKI KAISHA AUDIO-TECHNICA, Machida-shi, Tokyo (JP)

(72) Inventor: Hiroshi Akino, Machida (JP)

(73) Assignee: KABUSHIKI KAISHA AUDIO-TECHNICA, Machida-Shi, Tokyo (JP)

( * ) Notice: Subject to any disclaimer, the term of this patent is extended or adjusted under 35 U.S.C. 154(b) by 0 days.

(21) Appl. No.: 14/704,476

(22) Filed: May 5, 2015

(65) Prior Publication Data

US 2015/0341727 A1 Nov. 26, 2015

(30) Foreign Application Priority Data

May 20, 2014 (JP) ..... 2014-104387

(51) Int. Cl.

| | |
|---|---|
| ***H04R 1/00*** | (2006.01) |
| ***H04R 7/16*** | (2006.01) |
| ***H04R 9/02*** | (2006.01) |
| ***H04R 31/00*** | (2006.01) |
| ***H04R 7/12*** | (2006.01) |
| ***H04R 7/22*** | (2006.01) |
| ***H04R 9/04*** | (2006.01) |
| *G10K 13/00* | (2006.01) |

(52) U.S. Cl.

CPC .. *H04R 7/16* (2013.01); *H04R 7/12* (2013.01); *H04R 7/22* (2013.01); *H04R 9/025* (2013.01); *H04R 9/04* (2013.01); *H04R 31/00* (2013.01); *Y10T 29/49007* (2015.01)

(58) Field of Classification Search

CPC ..... H04R 7/16; H04R 7/20; H04R 31/003
USPC ..... 381/177, 398
See application file for complete search history.

(56) References Cited

U.S. PATENT DOCUMENTS

2009/0010480 A1* 1/2009 Ding ..... H04R 7/20 381/395

FOREIGN PATENT DOCUMENTS

JP 2013-141189 A 7/2013

* cited by examiner

*Primary Examiner* — Sunita Joshi
(74) *Attorney, Agent, or Firm* — Manabu Kanesaka

(57) ABSTRACT

In an electrodynamic electroacoustic transducer, a diaphragm assembly including a diaphragm and a voice coil is attached to a unit housing accurately and easily. A peripheral portion of the diaphragm curves upward while forming a downward convex portion toward an end portion side thereof. In an opening edge portion of the unit housing, a support base portion contacting the downward convex portion of the diaphragm is formed and a concave portion which a peripheral end portion of the diaphragm engages with is formed in an inside surface. In the diaphragm, the downward convex portion is supported by the support base portion of the unit housing in the peripheral portion thereof, so that the peripheral end portion engages with the concave portion of the unit housing in a state in which the peripheral end portion has upward elastic force.

13 Claims, 4 Drawing Sheets

ELECTRODYNAMIC ELECTROACOUSTIC TRANSDUCER, DIAPHRAGM THEREOF, AND METHOD OF MANUFACTURING THE SAME

RELATED APPLICATIONS

The present application is based on, and claims priority from, Japanese Application No. JP2014-104387 filed May 20, 2014, the disclosure of which is hereby incorporated by reference herein in its entirety.

BACKGROUND OF THE INVENTION

1. Field of the Invention

The present invention relates to an electrodynamic electroacoustic transducer, a diaphragm thereof, and a method of manufacturing the same. More particularly, the present invention relates to an electrodynamic electroacoustic transducer applied to a dynamic headphone or a dynamic microphone, a diaphragm thereof, and a method of manufacturing the same.

2. Description of the Related Art

A dynamic headphone or a dynamic microphone is an electrodynamic electroacoustic transducer that converts an electric signal into a sound wave or converts the sound wave into the electric signal, using the law of electromagnetic induction. FIG. 3 illustrates a cross-sectional view of a dynamic microphone unit. As illustrated in FIG. 3, a microphone unit 50 includes a magnetic circuit in which a disk-shaped pole piece 51 and a magnet 52 to be overlapped are surrounded by a yoke 53. In addition, a gap is formed between the pole piece 51 and the yoke 53. A cylindrical voice coil 55 attached to a diaphragm 54 is arranged in the gap in a vertically movable state.

The yoke 53 is held on an upper portion of a cylindrical unit housing 57. A unit frame 58 having an air chamber provided inside is held on a lower portion of the unit housing 57.

In addition, the diaphragm 54 is covered by a unit cap (resonator) 59 having a plurality of front portion acoustic terminals 59*a*.

In the microphone unit 50 configured as described above, if the diaphragm 54 is vibrated by the sound wave, the voice coil 55 vibrates vertically at the same time as the vibration of the diaphragm. As a result, electromotive force is generated in the coil and the microphone unit 50 outputs an audio signal based on the sound wave. Such a configuration of the dynamic microphone is disclosed in JP 2013-141189 A, for example.

FIG. 4 is a cross-sectional view of a state before the diaphragm 54, the voice coil 55, and the resonator 59 are attached to the unit housing 57.

Generally, the diaphragm 54 is manufactured by molding a plastic film under heating and pressure. In addition, the voice coil 55 is attached to the diaphragm 54 (referred to as a diaphragm assembly 56) and the diaphragm assembly 56 is attached to the unit housing 57.

Meanwhile, when the diaphragm assembly 56 is attached to the unit housing 57, an outer diameter of the diaphragm 54 needs to be smaller than an inner diameter of the unit housing 57. For this reason, a predetermined gap (about 0.1 to 0.4 mm) is provided in an outer diameter portion of the diaphragm 54 and an inner diameter portion of the unit housing 57.

In addition, in attachment work, an edge portion of the diaphragm is adhered to a peripheral portion of the unit housing 57 using an adhesive material. For this reason, it is necessary to press the edge portion of the diaphragm from the upper side using a weight until the adhesive material is solidified.

However, if the diaphragm is pressed by the weight, distortion occurs in the diaphragm 54. The distortion causes eccentricity at the center of the diaphragm 54 and the center of the unit housing 57. For this reason, the voice coil 55 contacts the magnetic circuit side and accurate mounting of the diaphragm assembly 56 is obstructed.

In the diaphragm pressed by the weight, the weight does not contact the peripheral portion of the diaphragm uniformly. For this reason, the diaphragm 54 and the unit housing 57 are fixed in a state in which stress is applied to the diaphragm 54. In the microphone, the stress lowers frequency response of a low frequency. In the case of the headphone, the stress generates chattering noise.

SUMMARY OF THE INVENTION

The present invention has been made in view of the above points and an object of the present invention is to provide an electrodynamic electroacoustic transducer in which a diaphragm assembly including a diaphragm and a voice coil is attached to a unit housing accurately and easily, a diaphragm thereof, and a method of manufacturing the same.

According to an aspect of the present invention for solving the above problems, there is provided an electrodynamic electroacoustic transducer that includes a unit housing that houses a magnetic circuit and a diaphragm attached to an opening edge portion of one end of the unit housing, and a voice coil provided at a bottom surface side of the diaphragm. A peripheral portion of the diaphragm curves upward while forming a downward convex portion toward an end portion side thereof. In the opening edge portion of the unit housing, a support base portion contacting the downward convex portion of the diaphragm is formed and a concave portion which a peripheral end portion of the diaphragm engages with is formed in an inside surface. In the diaphragm, the downward convex portion is supported by the support base portion of the unit housing in the peripheral portion thereof, so that the peripheral end portion engages with the concave portion of the unit housing in a state in which the peripheral end portion has upward elastic force.

The concave portion formed in the opening edge portion of the unit housing is preferably an annular concave portion formed along a circumferential direction of the unit housing and an engagement portion formed in the peripheral portion of the diaphragm is preferably the peripheral end portion of the diaphragm.

According to this configuration, the peripheral end portion engages with the concave portion of the unit housing in a state in which the peripheral portion of the diaphragm has the upward elastic force. Therefore, the diaphragm can be fixed firmly to the unit housing. Because distortion and deformation of the diaphragm do not occur, the center of the diaphragm and the center of the unit housing can be automatically aligned with each other and the diaphragm can be attached in a state in which stiffness is stabilized. Because stress by the deformation of the diaphragm does not occur, lowering of low frequency response of a microphone does not occur. In the case in which this configuration is applied to a headphone, occurrence of chattering noise by the stress can be prevented.

In addition, it is not necessary to form a gap to arrange a weight between the diaphragm and the peripheral portion of the unit housing as in the related art. Therefore, an effective area of the diaphragm can be increased as compared with a configuration according to the related art.

The peripheral portion of the diaphragm may be fixed to the opening edge portion of the unit housing by an adhesive material, in a state in which an engagement portion formed in the peripheral portion of the diaphragm engages with the concave portion formed in the opening edge portion of the unit housing.

For example, when the electrodynamic electroacoustic transducer according to the present invention is applied to a dynamic headphone, a diameter of the diaphragm increases, and thus, amplitude also increases. For this reason, it is preferable to fix the diaphragm to the unit housing using the adhesive material, in addition to the engagement of the diaphragm and the unit housing. Even in this case, because the diaphragm is fixed by the engagement with the unit housing, it is not necessary to fix the diaphragm by the weight until the adhesive material is solidified, as in the related art.

Further, according to another aspect of the present invention for solving the above problems, there is provided a diaphragm used in the electrodynamic electroacoustic transducer. The diaphragm is attached to the unit housing.

Further, according to another aspect of the present invention for solving the above problems, there is provided a method of manufacturing an electrodynamic electroacoustic transducer, the method includes providing a unit housing that houses a magnetic circuit and a diaphragm configured to be attached to an opening edge portion of one end of the unit housing; providing a voice coil at a bottom surface side of the diaphragm; curving a peripheral portion of the diaphragm upward while forming a downward convex portion toward an end portion side thereof; forming a concave portion in at least a part of the opening edge portion of the unit housing; forming an engagement portion engaging with the concave portion in the peripheral portion of the diaphragm; and engaging the engagement portion formed in the peripheral portion of the diaphragm with the concave portion formed in the opening edge portion of the unit housing.

According to this method, the peripheral end portion engages with the concave portion of the unit housing in a state in which the peripheral portion of the diaphragm has the upward elastic force. Therefore, the diaphragm can be fixed firmly to the unit housing. As a result, because distortion and deformation of the diaphragm do not occur, the center of the diaphragm and the center of the unit housing can be automatically aligned with each other and the diaphragm can be attached in a state in which stiffness is stabilized. Because stress by the deformation of the diaphragm does not occur, lowering of low frequency response of the microphone does not occur. In the case in which this configuration is applied to a headphone, because stress by the deformation of the diaphragm does not occur, occurrence of chattering noise can be prevented.

Because it is not necessary to form a gap to arrange a weight between the diaphragm and the peripheral portion of the unit housing as in the related art, an effective area of the diaphragm can be increased as compared with a configuration according to the related art.

According to the present invention, an electrodynamic electroacoustic transducer in which a diaphragm assembly including a diaphragm and a voice coil is attached to a unit housing accurately and easily, a diaphragm thereof, and a method of manufacturing the same can be obtained.

DESCRIPTION OF THE PREFERRED EMBODIMENTS

Figure 1:
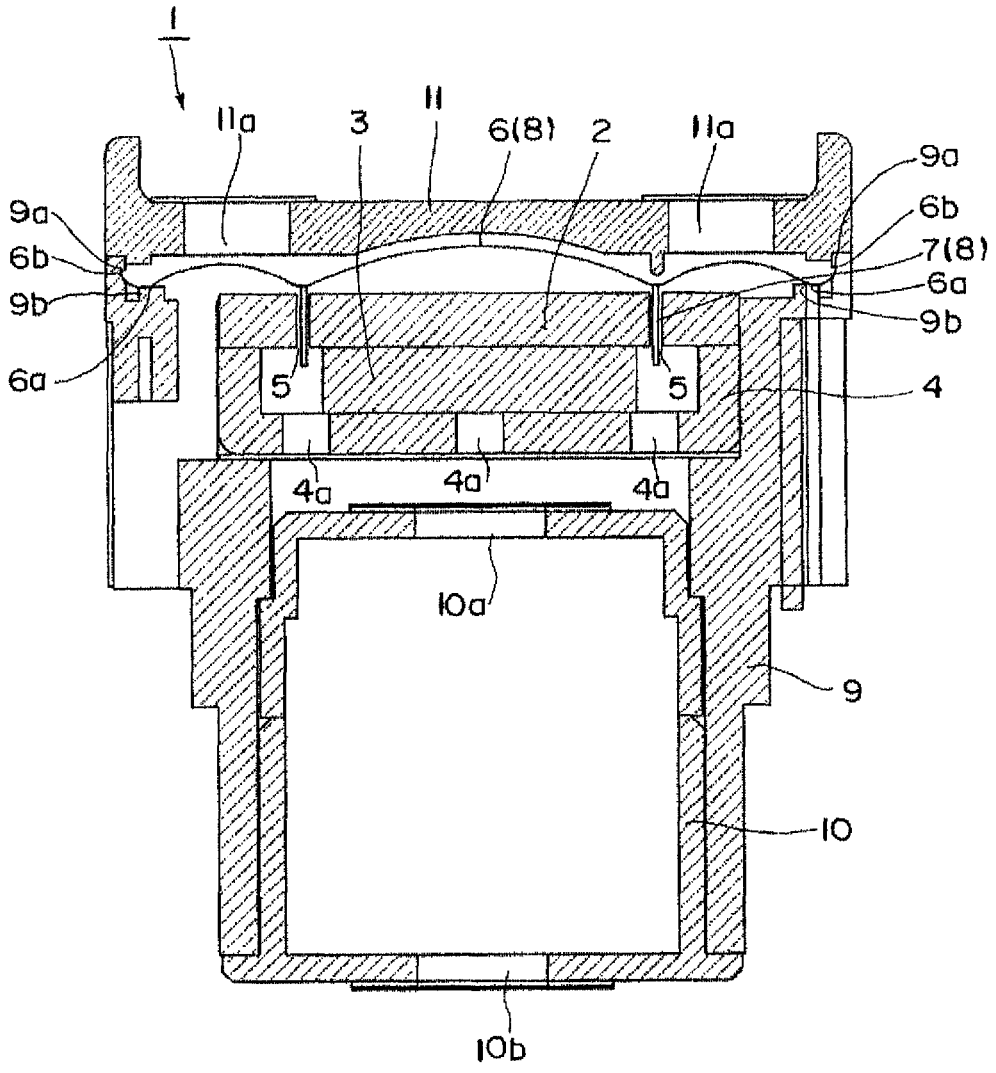
FIG. 1 is a cross-sectional view of a dynamic microphone unit to which an electrodynamic electroacoustic transducer according to the present invention is applied.

A detailed description will hereinafter be given of an embodiment of the present invention with reference to drawings. In the following embodiment, a dynamic microphone unit will be described as an example of an electrodynamic electroacoustic transducer according to the present invention. FIG. 1 is a cross-sectional view of the dynamic microphone unit to which the electrodynamic electroacoustic transducer according to the present invention is applied.

A dynamic microphone unit 1 of FIG. 1 includes a magnetic circuit. The magnetic circuit is configured by surrounding a bottom portion and side portions of a disk-shaped pole piece 2 and a magnet 3 overlapped to each other by a yoke 4. Predetermined gaps 5 are formed between the pole piece 2 and the yoke 4. In addition, a plurality of sound holes 4*a* are formed in a bottom surface of the yoke 4.

In addition, a diaphragm 6 made of a plastic film is arranged on the pole piece 2. A cylindrical voice coil 7 is attached to a bottom surface of the diaphragm 6.

A diaphragm assembly 8 is configured by the diaphragm 6 and the voice coil 7.

In addition, the voice coil 7 is arranged to vibrate vertically in the gap 5.

The diaphragm 6 is attached to an opening edge portion of one end side of a cylindrical unit housing 9. Specifically, as illustrated in an exploded view of FIG. 2, a peripheral portion of the diaphragm 6 has a shape in which the peripheral portion curves upward while forming a downward convex portion 6*a* toward an end portion side thereof. Meanwhile, a support base portion 9*b* extended in an upward convex shape (rib shape) along an opening is formed in the opening edge portion of one end side of the unit housing 9. In addition, an annular concave portion 9*a* is formed in an inside surface closer to the outside than the support base portion 9*b* in the opening edge portion. A peripheral end portion 6*b* of the diaphragm 6 can engage with the annular concave portion 9*a*.

Thereby, the downward convex portion 6*a* of the diaphragm 6 is supported by the support base portion 9*b* of the unit housing 9 and the peripheral end portion 6*b* (engagement portion) of the diaphragm 6 engages with the concave portion 9*a* of the unit housing 9. In addition, the peripheral end portion 6*b* engages with the concave portion 9*a* in a state in which the peripheral end portion 6*b* has elastic force in an upward direction using the downward convex portion 6*a* as a fulcrum point. For this reason, the diaphragm 6 is fixed firmly to the opening edge portion of the unit housing 9.

In addition, the magnetic circuit including the yoke 4, pole piece 2 and magnet 3 is held on an upper portion of the unit housing 9. The diaphragm 6 is attached to the unit housing 9 to cover the magnetic circuit. In addition, a unit frame 10 having an internal space is fitted into a lower portion of the unit housing 9.

Sound holes 10*a* and 10*b* are bored into top and bottom surfaces of the unit frame 10, respectively, to function as rear portion acoustic terminals. In addition, the internal space of the unit frame 10 may function as an air chamber. However, a damper material may be filled into the internal space to enable acoustic resistance to change.

In addition, a disk-shaped unit cap (resonator) 11 is provided to cover the diaphragm 6 attached to the unit housing 9. In the unit cap 11, front portion acoustic terminals 11*a* including a plurality of sound holes are provided.

Next, a process for attaching the diaphragm 6 to the unit housing 9 in the dynamic microphone unit 1 configured as described above will be described.

Figure 2:
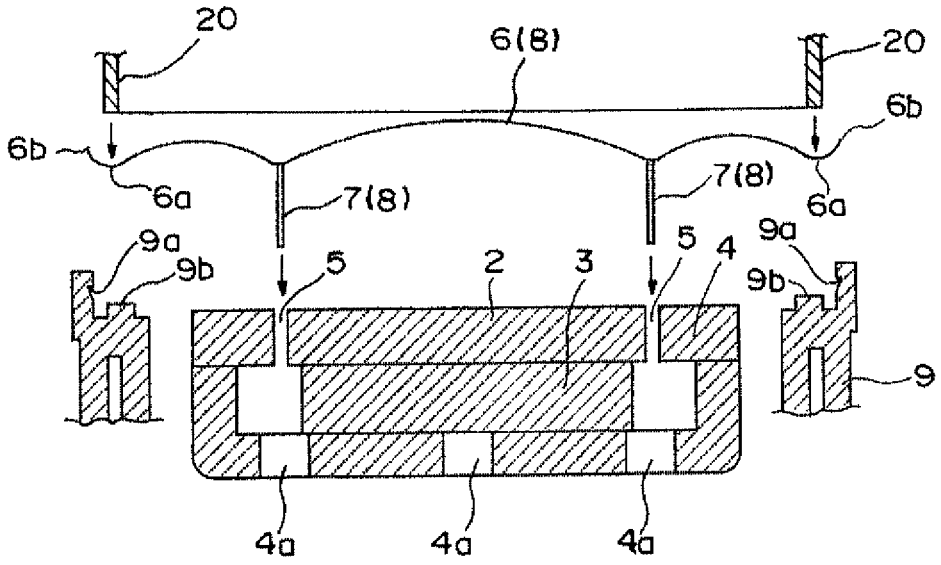
FIG. 2 is a cross-sectional view illustrating a process for attaching a diaphragm to a unit housing in the dynamic microphone unit of FIG. 1.
Figure 3:
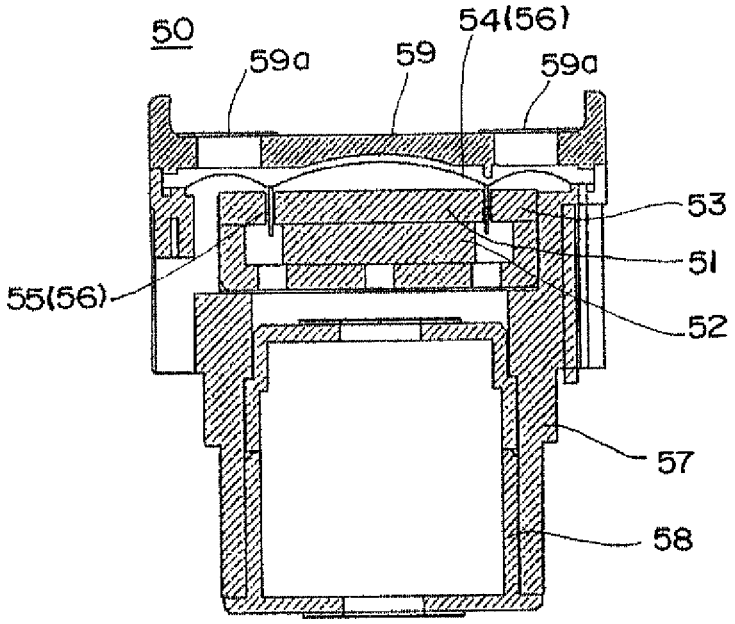
Fig. 3 Prior Art
FIG. 3 is a cross-sectional view of a dynamic microphone unit according to the related art.
Figure 4:
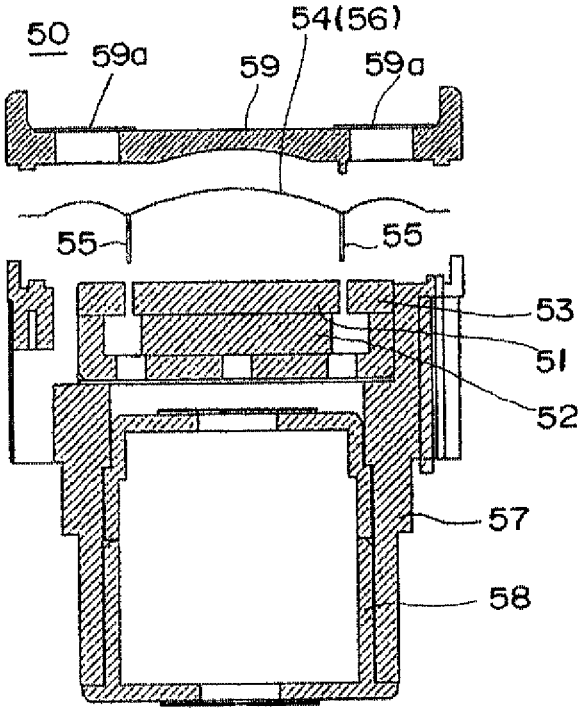
Fig. 4 Prior Art
FIG. 4 is a cross-sectional view illustrating a process for attaching a diaphragm to a unit housing in the dynamic microphone unit of FIG. 3.

First, as illustrated in FIG. 2, the diaphragm 6 is formed such that the peripheral portion thereof curves upward while forming the downward convex portion 6*a* toward an end portion (peripheral end portion 6*b*) and is cut.

Meanwhile, in the unit housing 9, the support base portion 9*b* is formed at the inside of the opening edge portion of one end thereof and an inverted hook-shaped concave portion 9*a* is formed in an inside surface of the outside thereof. A cut size of the diaphragm 6 is determined such that the peripheral end portion 6*b* of the diaphragm 6 contacts the concave portion 9*a* of the unit housing 9.

Next, the downward convex portion 6*a* provided in the peripheral portion of the diaphragm 6 contacts the support base portion 9*b* provided in the opening edge portion of the unit housing 9 and the peripheral portion of the diaphragm 6 is pressed using a cylindrical jig 20 as illustrated in FIG. 2. In addition, the peripheral end portion 6*b* is entered in the concave portion 9*a* of the unit housing 9 to engage with the concave portion 9*a*.

According to such an attachment structure, the peripheral end portion 6*b* engages with the concave portion 9*a* of the unit housing 9 in a state in which the peripheral portion of the diaphragm 6 has upward elastic force. Therefore, the diaphragm 6 can be fixed firmly to the unit housing 9. As a result, because distortion and deformation of the diaphragm 6 do not occur, the center of the diaphragm 6 and the center of the unit housing 9 can be automatically aligned with each other. Because eccentricity does not occur in the diaphragm 6 and the unit housing 9, the diaphragm 6 can be attached in a state in which stiffness is stabilized. Because stress by the deformation of the diaphragm 6 does not occur, lowering of low frequency response of the microphone does not occur. Similar to the above case, in the case in which this configuration is applied to a headphone, because stress by the deformation of the diaphragm 6 does not occur, occurrence of chattering noise can be prevented.

Because it is not necessary to form a gap to arrange a weight between the diaphragm 6 and the peripheral portion of the unit housing 9 as in the related art, an effective area of the diaphragm 6 can be increased as compared with a configuration according to the related art.

In the embodiment, the diaphragm 6 is attached by only the engagement of the diaphragm 6 and the unit housing 9, without using an adhesive material. However, the electrodynamic electroacoustic transducer according to the present invention is not limited to the embodiment.

For example, when the electrodynamic electroacoustic transducer according to the present invention is applied to a dynamic headphone, a diameter of the diaphragm increases, and thus, amplitude also increases. For this reason, it is preferable to fix the diaphragm to the unit housing using the adhesive material, in addition to the engagement of the diaphragm and the unit housing. Even in this case, because the diaphragm is fixed by the engagement with the unit housing, it is not necessary to fix the diaphragm by the weight until the adhesive material is solidified, as in the related art.

In addition, in the embodiment, the concave portion 9*a* provided in the opening edge portion of the unit housing 9 is used as an annular concave portion formed in a circumferential direction along an inner circumferential surface. However, a plurality of concave portions may be provided at the same interval along the circumferential direction. In this case, a convex portion capable of engaging with the peripheral end portion of the diaphragm 6 may be formed according to an arrangement of the concave portions of the unit housing 9.

In addition, in the embodiment, the elastic force of the peripheral portion of the diaphragm 6 is changed by an elevation difference of a position of the concave portion 9*a* in the opening edge portion of the unit housing 9 and a position of the support base portion 9*b*. According to the change, the stiffness of the diaphragm 6 also changes. For this reason, the low frequency response can be changed by the elevation difference of the concave portion 9*a* and the support base portion 9*b* of the unit housing 9.

In addition, in the embodiment, the dynamic microphone unit is described as the example of the electrodynamic electroacoustic transducer according to the present invention. However, the present invention is not limited thereto and can be applied to a dynamic headphone.

In addition, in the embodiment, the unit housing 9 has a cylindrical shape. However, the shape of the unit housing 9 is not limited to the cylindrical shape. That is, the unit housing 9 may be a housing that has an opening capable of attaching the diaphragm and can house the magnetic circuit. For example, the unit housing 9 may have a disk shape adopted in the headphone.

What is claimed is:

1. An electrodynamic electroacoustic transducer comprising:

a unit housing that houses a magnetic circuit;

a diaphragm attached to an opening edge portion of one end of the unit housing; and a voice coil provided at a bottom surface side of the diaphragm, wherein the diaphragm includes a downward convex portion toward an end portion side, and a peripheral portion curved upward from the downward convex portion and having a peripheral end, the opening edge portion of the unit housing includes a support base portion contacting the downward convex portion of the diaphragm and a concave portion dented radially outwardly away from the support base in an inside surface of the opening edge portion, the peripheral end of the of the diaphragm engaging the concave portion, and in the diaphragm, the downward convex portion is supported by the support base portion of the unit housing in the peripheral portion thereof, so that the peripheral end engages with the concave portion of the unit housing in a state in which the peripheral portion has an upward elastic force.

2. The electrodynamic electroacoustic transducer according to claim 1, wherein the concave portion formed in the opening edge portion of the unit housing is an annular concave portion formed along a circumferential direction of the unit housing and an engagement portion formed in the peripheral portion of the diaphragm is the peripheral end of the diaphragm.

3. The electrodynamic electroacoustic transducer according to claim 1, wherein the peripheral portion of the diaphragm is adhered to the opening edge portion of the unit housing by an adhesive material and is fixed to the opening edge portion, in a state in which an engagement portion formed in the peripheral portion of the diaphragm engages with the concave portion formed in the opening edge portion of the unit housing.

4. The electrodynamic electroacoustic transducer according to claim 2, wherein the peripheral portion of the diaphragm is adhered to the opening edge portion of the unit housing by an adhesive material and is fixed to the opening edge portion, in a state in which an engagement portion formed in the peripheral portion of the diaphragm engages with the concave portion formed in the opening edge portion of the unit housing.

5. A diaphragm that is used in the electrodynamic electroacoustic transducer according to claim 1, wherein the diaphragm is attached to the unit housing.

6. A diaphragm that is used in the electrodynamic electroacoustic transducer according to claim 2, wherein the diaphragm is attached to the unit housing.

7. A diaphragm that is used in the electrodynamic electroacoustic transducer according to claim 3, wherein the diaphragm is attached to the unit housing.

8. A diaphragm that is used in the electrodynamic electroacoustic transducer according to claim 4, wherein the diaphragm is attached to the unit housing.

9. A method of manufacturing an electrodynamic electroacoustic transducer comprising:

providing a unit housing that houses a magnetic circuit, and a diaphragm configured to be attached to an opening edge portion of one end of the unit housing;

providing a voice coil at a bottom surface side of the diaphragm;

curving a peripheral portion of the diaphragm upward while forming a downward convex portion toward an end portion side thereof;

forming a concave portion dented in an inside surface of the opening edge portion of the unit housing;

forming an engagement portion with a peripheral end engaging with the concave portion in the peripheral portion of the diaphragm; and engaging the peripheral end of the engagement portion formed in the peripheral portion of the diaphragm with the concave portion formed in the opening edge portion of the unit housing.

10. The electrodynamic electroacoustic transducer according to claim 1, wherein the opening edge portion of the unit housing further comprises a bottom portion having the support base portion protruding axially upwardly and a wall portion extending upwardly from the bottom portion at a position radially outward from the support base portion, the wall portion having the concave portion in the inside surface thereof.

11. The electrodynamic electroacoustic transducer according to claim 10, wherein the peripheral portion of the diaphragm has the downward convex portion protruding toward the support base portion to abut against the support base portion, and the peripheral end portion extending outwardly from the downward convex portion and upwardly away from the support base portion to abut against the concave portion.

12. The method of manufacturing an electrodynamic electroacoustic transducer according to claim 9, wherein in engaging the engagement portion with the concave portion, the peripheral portion of the diaphragm is pressed by a cylindrical jig into the concave portion.

13. An electrodynamic electroacoustic transducer comprising:

a unit housing that houses a magnetic circuit;

a diaphragm attached to an opening edge portion of one end of the unit housing; and a voice coil provided at a bottom surface side of the diaphragm, wherein a peripheral portion of the diaphragm curves upward while forming a downward convex portion toward an end portion side thereof, in the opening edge portion of the unit housing, a support base portion contacting the downward convex portion of the diaphragm is formed and a concave portion which a peripheral end portion of the diaphragm engages with is formed in an inside surface, in the diaphragm, the downward convex portion is supported by the support base portion of the unit housing in the peripheral portion thereof, so that the peripheral end portion engages with the concave portion of the unit housing in a state in which the peripheral end portion has an upward elastic force, the concave portion formed in the opening edge portion of the unit housing is an annular concave portion formed along a circumferential direction of the unit housing and an engagement portion formed in the peripheral portion of the diaphragm is the peripheral end portion of the diaphragm, and the peripheral portion of the diaphragm is adhered to the opening edge portion of the unit housing by an adhesive material and is fixed to the opening edge portion, in a state in which an engagement portion formed in the peripheral portion of the diaphragm engages with the concave portion formed in the opening edge portion of the unit housing.

* * * * *